United States Patent [19]

Kinslow

[11] 4,144,985

[45] Mar. 20, 1979

[54] CLOSURE FASTENING MEANS

[75] Inventor: William G. Kinslow, Kansas City, Mo.

[73] Assignee: Ethyl Development Corporation, Baton Rouge, La.

[21] Appl. No.: 908,089

[22] Filed: May 22, 1978

[51] Int. Cl.[2] ..... B65D 51/18

[52] U.S. Cl. ..... 220/254; 220/307; 220/339; 222/556

[58] Field of Search ..... 220/254, 306, 339, 307; 215/321, 237

[56] References Cited

U.S. PATENT DOCUMENTS

| | | | |
|---|---|---|---|
| 3,872,996 | 3/1975 | Dogliotti | 220/254 |
| 3,966,080 | 6/1976 | Bittel | 220/307 X |

FOREIGN PATENT DOCUMENTS

| | | | |
|---|---|---|---|
| 1258979 | 1/1972 | United Kingdom | 220/339 |

*Primary Examiner*—George T. Hall

*Attorney, Agent, or Firm*—Donald L. Johnson; John F. Sieberth; Edgar E. Spielman, Jr.

[57] ABSTRACT

A package which includes a hollow container having a substantially rectangular mouth and a substantially rectangular, hollow, plastic plug for fitment to the container mouth is disclosed. The plug has a top wall with an opening therein through which ingredients from the container are dispensed. A hinged flap, which is integral with the top wall, is utilized to close off the opening. A cooperating snap-action means, which is integral with the plug, is provided to maintain the flap in a closed position when the contents of the container is not being dispensed. The snap-action means has a first portion and a second portion with the first portion being carried on the flap at its free end and the second portion being disposed adjacent the top wall. Each portion of the snap-action means provides a complementary surface to achieve closing which surfaces run parallel to the line along which the hinge lies.

10 Claims, 6 Drawing Figures

CLOSURE FASTENING MEANS

BACKGROUND OF THE INVENTION

This invention relates to a package which is particularly suitable for use in packaging grain-like food stuffs. The package must also have the ability to dispense its contents in a controlled manner and be reclosable until subsequent dispensing of the contents of the container is desired.

THE INVENTION

This invention relates to a package which comprises a hollow container having a substantially rectangular mouth and a hollow plastic plug having a substantially rectangular cross-section with a long side and a short side. The plug includes: a top wall having an opening extending in the direction of the long side of the plug from the short side thereof; a skirt downwardly depending from the top wall and adapted to obtain fitment with the container mouth and the skirt having a stepped portion for bearing on the edge of such mouth upon fitment of the plug to the container; a flap adapted to close the opening, which flap is integrally formed and hinged to the top wall at the end of the opening remote from the short side with the integral hinge extending along a line perpendicular to the long side; a recess in the plug adapted to receive the free end of the flap in its closed position and a cooperating snap-action means integral with the plug to maintain the flap in the closed position when desired. The snap-action means has a first portion on the bottom surface of the flap at its free end and a second portion disposed adjacent the recess, with the first and second portions having complementary coupling surfaces extending in a direction perpendicular to the long side of the plug. The second portion individually has an inwardly extending horizontal wall; an inwardly and downwardly directed beveled wall depending from the innermost end of the horizontal wall; a second horizontal wall inwardly extending and spaced downwardly from the lowermost extent of the beveled wall; and a vertical connecting wall connecting the lowermost extent of the beveled wall to the innermost extent of the second horizontal wall. The first portion individually has: a downwardly extending vertical wall, the vertical wall having a downward extent approximate the vertical distance between the first and second horizontal walls; a latch wall outwardly extending from the vertical wall to an extent such that when the vertical wall and the connecting wall are in contact the latch wall extends beneath the second horizontal wall; and a downwardly and outwardly extending wall connected at one of its ends to the top wall and at its other end to the latch wall.

By having the above-described snap-action latch it is possible to produce a hollow, plastic plug which features complementary coupling surfaces which extend in a direction perpendicular to the long side of the plug (and also parallel to the hinge connecting the top wall and flap) while not sacrificing any latching fidelity even after numerous openings and closings of the flap. It is also possible, with the snap-action means of this invention, to produce a high quality, plastic plug without requiring extremely narrow production tolerances as is taught in the art for such snap-action latches.

These and other features of the present invention contributing satisfaction in use and economy in manufacture will be more fully understood when taken in connection with the accompanying drawings in which identical numerals refer to identical parts and in which.

Figure 1:
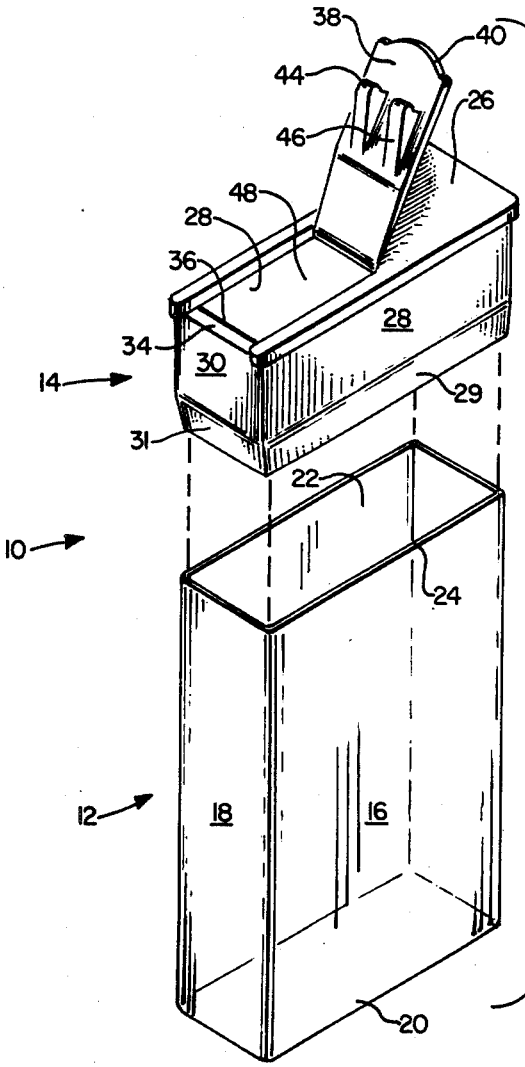
FIG. 1 is an exploded perspective view of a package of this invention.
Figure 5:
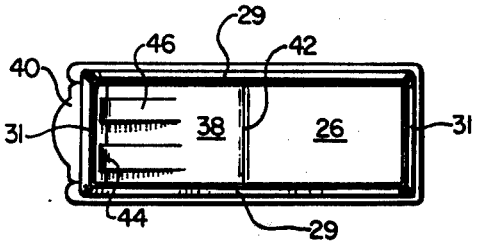
FIG. 5 is a bottom plan view of the hollow plastic plug shown in FIG. 1.

Referring now to FIG. 1, it can be seen that a package of this invention, generally designated by the numeral 10, includes a hollow container, generally designated by the numeral 12, and a hollow plastic plug, generally designated by the numeral 14. As can be appreciated from the drawings, both container 12 and hollow plastic plug 14 are substantially rectangular in cross-section. Hollow container 12 includes a bottom wall 20, two closed short sidewalls 18 and two opposed long sidewalls 16. Bottom wall 20 may be integrally formed with sidewalls 18 and 16 or may be in the form of an insert which is held to the main body of hollow container 12 by means of an adhesive. As can be seen in FIG. 1, hollow container 12 has a substantially rectangular mouth 22.

Hollow plastic plug 14 has a pair of opposed long sidewalls 28 and a pair of opposed short sidewalls 30. As can be seen in FIGS. 1, 3, 4 and 5, long sidewalls 28 and short sidewalls 30 have, respectively, beveled portions 29 and 31. It has been found preferred to provide the sidewalls with the beveled portions to facilitate mechanical placement of hollow plastic plug 14 into mouth 22 of container 12. In the embodiment shown in the drawings, long sidewalls 28 and one of the short sidewalls 30 form a stepped out ridge which ridge will bear on edge 24 of container mouth 22. At the upper extent of the sidewalls and integrally formed therewith is top wall 26. As is shown in FIG. 1, top wall 26 has therein opening 48. Opening 48, in the embodiment shown, extends in a direction along the long sidewalls 28 from a point adjacent to one of the short sidewalls 30. With opening 48 having this configuration it can be seen that there is provided recess 34 for nesting flap 38 as hereinafter described.

Flap 38 is of the same shape, i.e., generally rectangular, as opening 48. Flap 38 is hinged to and integrally formed with top wall 26. Hinge 42, for the plug illustrated, is formed by a thinned-out portion of flap 38. When hollow plastic plub 14 is molded, flap 38 will bemolded in the up position to provide upward bias of flap 38 resulting in an upward moment being placed on the snap-action means hereinafter described. It should be noted that hinge 42 runs perpendicular to long sidewalls 28.

Cooperating snap-action means is provided to selectively maintain flap 38 in the closed position. As mentioned previously, the cooperating snap-action means provides complementary coupling surfaces which extend in a direction parallel to hinge 42 and perpendicular to long sidewalls 28.

Cooperating snap-action means has a first portion—which includes two parts 44 and 46—and a second portion 36 which is located adjacent recess 34. Second portion 36 is detailed in FIG. 4A and is defined by an inwardly extending first horizontal wall 56, an inwardly and downwardly extending beveled wall 58, a vertical wall 60 and a second horizontal inwardly extending wall 62. As can be appreciated from FIG. 4A, vertical wall 60 connects second horizontal wall 62 with beveled wall 58. FIG. 1 shows that second portion 36 extends full length across opening 48 and is a preferred mode. Other modes, in which second portion 36 does not extend fully across opening 48, are also useful and may be used where desired.

As mentioned previously, first portion, for the embodiment shown, includes two parts 44 and 46. However, it is not necessary that two parts be utilized in all instances. For instance, if the flap is narrow a single part may be used while on the other hand multiple parts are desirable when opening 48 is wide enough to require such to overcome any twisting tendencies of flap 38.

To achieve the snap-action desirable, parts 44 and 46 must have a shape which will achieve a secure latch and at the same time not require extremely narrow production tolerances to achieve the latching characteristics required. A highly preferred shape is shown in the enlarged view depicted in FIG. 4A in which part 44, which is identical to part 46, is defined by a downwardly extending vertical wall 54 which wall has a downward extent approximate the vertical distance between first horizontal wall 56 and second horizontal wall 62. Immediately below downwardly extending vertical wall 54 is latch wall 52, which for the embodiment shown, has an outwardly curved shape when viewed in cross-section—the cross-section being taken parallel to the long axis of hollow plastic plug 14. Connecting the other end of latch wall 52 to the bottom side of top wall 26 is a downwardly and outwardly extending wall 50. This wall provides parts 44 and 46 with a shape which insures necessary rigidity of these parts. Parts 44 and 46, in addition to the walls described immediately above, have sidewalls, as shown in FIG. 1, which are necessary to close off parts 44 and 46.

Figure 4A:
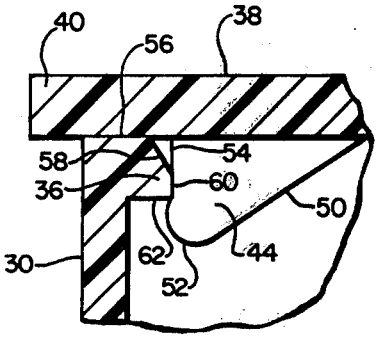
FIG. 4A is an enlarged view of the cooperating snap-action means shown in FIG. 4.
Figure 2:
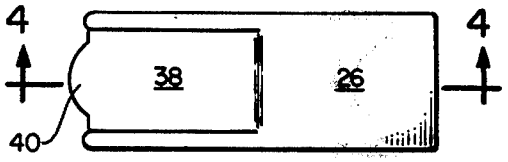
FIG. 2 is a top plan view of the hollow plastic plug shown in FIG. 1.
Figure 4:
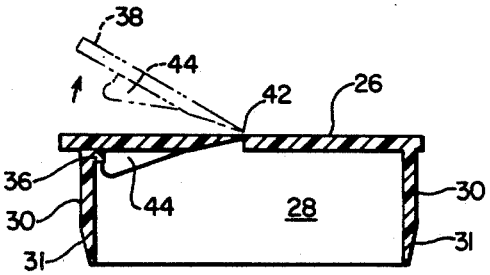
FIG. 4 is a sectional view taken along section lines 4—4 in FIG. 2.
Figure 3:
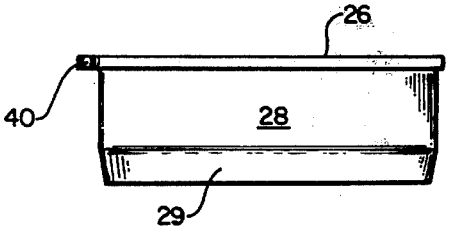
FIG. 3 is a side elevation view of the hollow plastic plug shown in FIG. 1.

In operation hollow plastic plug 14 has its opening, opening 48, closed by pressing down flap 38 until the latch walls of parts 44 and 46 have passed down over beveled wall 58 to nest beneath second horizontal wall 62. As can be seen in FIG. 4A, a latch will occur at the interface between vertical connecting wall 60 (a first surface) and the intersection of vertical wall 54 and latch wall 52 (a second surface). To open flap 38 the user need only grab the convenience tab 40 and pull upwardly until the latch walls of parts 44 and 46 unnest beneath second horizontal wall 62, pass over vertical connecting wall 60 and continue over vertical connecting wall 60. Once the latch walls are above the intersection of second horizontal wall 62 and connecting wall 60 the latch action of the snap-action will be lost and flap 38 will be free to open.

Hollow, plastic plug 14 can be made of any convenient plastic material which is capable of some resilient deformation. It has been found that materials such as high density polyethylene, ployethylene terethalate, high density Nylon, etc., may be utilized. Formation of hollow plastic plug 14 may be accomplished by any of the well known injection molding techniques known in the art. The material of construction for hollow container 12 is optional with plastics, glass, metals all being suitable for use. The formation of hollow container 12 can be any of the conventional modes of formation for such a container out of the material selected.

What is claimed is:

1. A hollow plastic plug for fitment to the mouth of a container having a substantially rectangular mouth, said plug having:

a. a substantially rectangular cross-section with a long side and a short side;

b. a top wall having an opening extending in the direction of the long side of said plug from the short side thereof;

c. a skirt downwardly depending from said top wall and adapted to obtain said fitment, said skirt having a stepped portion for bearing on the edge of the container mouth upon fitment of said plug to said container;

d. a flap, adapted to close said opening, integrally formed and hinged to the top wall at the end of said opening remote from said short side, said hinge extending along a line perpendicular to said long side;

e. a recess in said plug adapted to receive the free end of said flap in its closed position; and f. a cooperating snap-action means integral with said plug and having a first portion on the bottom surface of said flap at its free end and a second portion disposed adjacent said recess, said first and second portions having complementary coupling surfaces extending in a direction perpendicular to said long side of said plug, and said second portion having, i. an inwardly extending horizontal wall, ii. an inwardly and downwardly directed beveled wall depending from the innermost end of said horizontal wall, iii. a second horizontal wall inwardly extending and spaced downwardly from the lowermost extent of said beveled wall, and iv. a vertical connecting wall connecting said lowermost extent of said beveled wall to the innermost extent of said second horizontal wall, and said first portion having, v. a downwardly extending vertical wall, said vertical wall having a downward extent approximate the vertical distance between said first and second horizontal walls, vi. a latch wall outwardly extending from said vertical wall to an extent such that when said vertical wall and said connecting wall are in contact said latch wall extends beneath said second horizontal wall, and vii. a downwardly and outwardly extending wall connected at one of its ends to said top wall and at its other end to said latch wall.

2. The hollow plastic plug of claim 1 wherein said hinge is formed by a thinned-out portion of said top wall.

3. The hollow plastic plug of claim 1 wherein said latch wall of said first portion has an outwardly disposed curved shape in cross-section, said cross-section taken parallel to the long axis of said hollow plastic plug.

4. The hollow plastic plug of claim 1 wherein said first portion has two parts, each of said parts having: a downwardly extending, vertical wall, said vertical wall having a downward extent approximate the vertical distance between said first and second horizontal walls; a latch wall outwardly extending from said vertical wall to an extent such that when said vertical wall and said connecting wall are in contact said latch wall extends beneath said second horizontal wall; and a downwardly and outwardly extending wall connected at one of its ends to said top wall and at its other end to said latch wall.

5. The hollow plastic plug of claim 1 wherein said plug is of high density polyethylene.

6. A package comprising:

A. a hollow container having a substantially rectangular mouth,

B. a hollow plastic plug having:

a. a substantially rectangular cross-section with a long side and a short side;

b. a top wall having an opening extending in the direction of the long side of said plug from the short side thereof;

c. a skirt downwardly depending from said top wall and adapted to obtain said fitment, said skirt having a stepped portion for bearing on the edge of the container mouth upon fitment of said plug to said container;

d. a flap, adapted to close said opening, integrally formed and hinged to the top wall at the end of said opening remote from said short side, said hinge extending along a line perpendicular to said long side;

e. a recess in said plug adapted to receive the free end of said flap in its closed position; and f. a cooperating snap-action means integral with said plug and having a first portion on the bottom surface of said flap at its free end and a second portion disposed adjacent said recess, said first and second portions having complementary coupling surfaces extending in a direction perpendicular to said long side of said plug, and said second portion having, i. an inwardly extending horizontal wall, ii. an inwardly and downwardly directed beveled wall depending from the innermost end of said horizontal wall, iii. a second horizontal wall inwardly extending and spaced downwardly from the lowermost extent of said beveled wall, and iv. a vertical connecting wall connecting said lowermost extent of said beveled wall to the innermost extent of said second horizontal wall, and said first portion having, v. a downwardly extending vertical wall, said vertical wall having a downward extent approximate the vertical distance between said first and second horizontal walls, vi. a latch wall outwardly extending from said vertical wall to an extent such that when said vertical wall and said connecting wall are in contact said latch wall extends beneath said second horizontal wall, and vii. a downwardly and outwardly extending wall connected at one of its ends to said top wall and at its other end to said latch wall.

7. The hollow plastic plug of claim 6 wherein said hinge is formed by a thinned-out portion of said top wall.

8. The hollow plastic plug of claim 6 wherein said latch wall of said first portion has an outwardly disposed curved shape in cross-section, said cross-section taken parallel to the long axis of said hollow plastic plug.

9. The hollow plastic plug of claim 6 wherein said first portion has two parts, each of said parts having: a downwardly extending vertical wall, said vertical wall having a downward extent approximate the vertical distance between said first and second horizontal walls; a latch wall outwardly extending from said vertical wall to an extent such that when said vertical wall and said connecting wall are in contact said latch wall extends beneath said second horizontal wall; and a downwardly and outwardly extending wall connected at one of its ends to said top wall and at its other end to said latch wall.

10. The hollow plastic plug of claim 6 wherein said plug is of high density polyethylene.

* * * * *